US006568135B1

(12) United States Patent
Yokoyama et al.

(10) Patent No.: US 6,568,135 B1
(45) Date of Patent: May 27, 2003

(54) SOUND ABSORBING STRUCTURE

(75) Inventors: Yoshiaki Yokoyama, Omuta (JP); Shinji Migita, Omuta (JP); Shinichi Okuzono, Omuta (JP); Kyoji Fujiwara, Chikushi (JP); Takuya Fujimoto, Fukuoka (JP); Yukio Hattori, Chiba (JP)

(73) Assignees: Nichias Corporation, Tokyo (JP); Alumu Corporation, Fukuoka (JP); Yotsumoto Acoustic Design Inc., Fukuoka (JP)

( * ) Notice: Subject to any disclaimer, the term of this patent is extended or adjusted under 35 U.S.C. 154(b) by 0 days.

(21) Appl. No.: 09/556,429

(22) Filed: Apr. 24, 2000

(30) Foreign Application Priority Data

Apr. 22, 1999 (JP) ..... 11-115488
Oct. 27, 1999 (JP) ..... 11-305412

(51) Int. Cl.[7] ..... E04B 1/82

(52) U.S. Cl. ..... 52/145; 52/144; 181/208; 181/286; 181/288; 181/290

(58) Field of Search ..... 52/144, 145; 181/284, 181/286, 290, 208

(56) References Cited

U.S. PATENT DOCUMENTS 2,161,708 A * 6/1939 Heerwagen ..... 52/144
4,416,349 A * 11/1983 Jacobs ..... 52/145
5,905,234 A * 5/1999 Tsukamoto et al. ..... 181/286

FOREIGN PATENT DOCUMENTS

| | | | |
|---|---|---|---|
| EP | 0405581 A1 * | 1/1991 | ..... 181/284 |
| JP | 4-76117 | 12/1992 | |
| JP | 5-2646 | 1/1993 | |
| JP | 8-68018 | 3/1996 | |
| KR | 1998-087557 | 12/1998 | |
| WO | WO 99/63169 | 12/1999 | |

* cited by examiner

*Primary Examiner*—Carl D. Friedman
*Assistant Examiner*—Yvonne M. Horton
(74) *Attorney, Agent, or Firm*—Nixon & Vanderhye P.C.

(57) ABSTRACT

A sound absorbing structure including a sound absorbing member, an air layer, and a resonant sound absorbing structure. The air layer is formed in the rear of the sound absorbing member. The resonant sound absorbing structure includes a slit and is formed in the rear of the sound absorbing member. The sound absorbing member is a surface plate covering the rear air layer and the resonant sound absorbing structure, and the sound absorbing member is shaped in one of a plate and plane.

12 Claims, 9 Drawing Sheets

REGION A

REGION B

REGION C

| OPTIMUM STRUCTURE (mm) | m | n | o | p | q | r | AVERAGE OBLIQUE INCIDENT SOUND ABSORPTION COEFFICIENT |
|---|---|---|---|---|---|---|---|
| | 13 | 33 | 46 | 18 | 29 | 41 | 0.955 |

SOUND ABSORBING STRUCTURE

BACKGROUND OF THE INVENTION

1. Field of the Invention

The present invention relates to a sound absorbing structure excellent in durability, weather resistance and recycling easiness.

2. Description of the Related Art

Sound-proof walls for preventing noise are provided for an expressway and a railroad. In general, the sound-proof wall is constituted by sound absorbing panels each having a panel-shape structure which accommodates inorganic fibers, such as glass wool or rock wool.

The sound absorbing panel constituted by the inorganic fibers suffers from the following problems:

(1) Glass wool and the like have a problem of unsatisfactory water draining performance. When moisture content is absorbed, the sound absorbing performance deteriorates. Therefore, complicated maintenance of the performance must be performed.

(2) Glass wool and the like encounter "fatigue" owing to use for a long time. Thus, the sound absorbing performance and the strength deteriorate.

(3) When the period of durability has elapsed, recycling requires a great cost. In general, a waste disposal process of the glass wool or the like must be performed as the industrial waste. In the foregoing case, recycling of rock wool does not require a high cost which is required for the glass wool. However, the cost is not satisfactorily low.

(4) When the glass wool or the like is exposed to air flows, flying and flotation of the fibers easily occurs. Thus, the sound absorbing performance deteriorates.

(5) In an environment, such as a location for manufacturing foods or chemicals, which requires a high degree of cleanness, flying and flotation of fibers cause a problem to arise. Therefore, the foregoing material cannot easily be employed.

(6) When the foregoing material is handled, there arises problems of aspiration and prickling of the fibers.

(7) The inorganic fibers deteriorate and become brittle owing to exposure to ultraviolet rays for a long time. Therefore, a countermeasure against the foregoing problem must be taken when the inorganic fibers is used outdoors.

(8) To solve the problems (1) and (4) to (7), a means for covering the inorganic fiber material with PVF films or the like is employed. In this case, there arises a problem in that the sound absorbing performance deteriorates and the films are broken.

Since a large quantity of the sound absorbing panels are used especially in a an expressway and railroad, the foregoing problem (3) is a critical problem which must be solved also from a viewpoint of the environment protection.

As a sound absorbing material which does not raise the problems experienced with the inorganic fibers, for example, a structure formed into a plate-like shape is known which is obtained by pressurizing and compressing aluminum fibers. Also a sound absorbing member is known which is obtained by foaming sintered aluminum particles or an aluminum material.

The sound absorbing member made of the foregoing metal material encounters a problem of inferior sound absorbing performance to that of the sound absorbing member made of the inorganic fibers, such as glass wool or the rock wool.

The foregoing sound absorbing members absorb sound by converting a part of acoustic energy into heat energy caused from friction of molecules in the air against the fibers and the particles when the molecules in the air pass through the gaps of the fibers or the particles.

The effect of absorbing sound using the foregoing sound absorbing member can be improved such that further bass range sound can be absorbed when the thickness of the rear air layer is enlarged. In usual, the size (in particular, the thickness) of the sound absorbing panel is, however, limited. Therefore, satisfactory sound absorbing performance cannot easily be realized in a frequency range not higher than 500 Hz. In particular, the sound absorbing member of a type constituted by the metal material demonstrates a propensity to have the foregoing characteristic.

As one of means for absorbing sound, a method is known which uses the following resonant structure. That is, the method uses the Helmholtz resonant structure as the basic principle thereof. As distinct from the sound absorbing member represented by fibers, frictional loss of movement of air occurring when the resonant structure called a Helmholtz resonator causes loss of the acoustic energy in the vicinity of the resonant frequency range to be produced. Thus, sound absorbing effect can be obtained.

As a representative sound absorbing structure using the Helmholtz resonator as the principle thereof, a structure is exemplified in which the surface of the wall is constituted by plates each having a multiplicity of openings or slits. Moreover, an air layer is formed in the rear portion of the sound absorbing structure. In this specification, a structure using the Helmholtz resonance as the basic principle for absorbing sound is hereinafter called a resonant sound absorbing structure.

A usual resonant sound absorbing structure encounters a problem in that the sound absorbing performance can be obtained only in a range in the vicinity of a specific resonant frequency. However, the foregoing structure has a characteristic that sound absorption is permitted in a bass range which cannot easily be realized when the sound absorbing member is employed.

In Japanese Examined Utility Model Publication Hei. 5-2646, a structure has been disclosed which includes sound absorbing members each incorporating aluminum fibers to serve as the sound absorbing materials, wherein the sound absorbing members are disposed in a state where air layers are formed such that the sound absorbing members are disposed apart from one another. Thus, sound absorption owing to the sound absorbing members and sound absorption owing to the resonant structure (resonant spaces) constituted by the gaps of the sound absorbing members and the rear air layers can simultaneously be performed.

The foregoing structure incorporating the aluminum fibers is able to solve the problems experienced with the structure incorporating the inorganic fiber sound absorbing member. Moreover, the sound absorbing performance in the bass range is attempted to be improved by also employing the resonant sound absorbing structure. The disclosed structure, however, has a problem in that a complicated structure is required and installation of the structure cannot be easily performed.

In general, the sound absorbing member constituted by forming aluminum fibers into a plate-like shape suffers from unsatisfactory strength. Therefore, a large size structure cannot be realized. Hence it follows that a satisfactorily large sound absorbing member cannot be obtained by the disclosed structure. Thus, there arises a problem in that a multiplicity of sound absorbing members must be joined and, therefore, the cost required to install the structure becomes high.

Moreover, the sound absorbing members must individually be disposed at positions apart from one another for predetermined distances. In addition, the air layers must be formed in a state where the sound absorbing members have been disposed. As a result, the overall structure is enlarged and complicated excessively. It leads to a fact that the cost required to install the structure becomes high.

The foregoing structure does not permit a sufficiently long length of the neck in each gap (the dimension in the direction of the depth of the inlet/outlet portion of the resonant structure). Therefore, when a resonant sound absorbing structure which is effective up to a furthermore bass range is required, the capacity of the resonant space must be enlarged. Hence it follows that the overall structure is enlarged excessively. Thus, the portion for which the sound absorbing structure can be provided is limited. When the space for installing the sound absorption structure required for a road or a railway is usually limited. Therefore, thick air layers cannot easily be provided. As a result, the foregoing structure cannot be easily put into practical use.

Therefore, development of a sound absorbing structure having a small thickness and free from limitation of the portion for installation is required.

SUMMARY OF THE INVENTION

In view of the foregoing, an object of the present invention is to provide a sound absorbing structure incorporating a metal material serving as a sound absorbing member and satisfying the following requirements.

(1) Both of the sound absorbing effect obtainable from the sound absorbing member and the sound absorbing effect obtainable from the slit resonant sound absorbing structure are used to improve the sound absorbing performance in a bass range.

(2) A high sound absorbing performance can be realized in a wide frequency range.

(3) A structure is free from useless portions and simple, and the weight can be reduced.

(4) The installation of the structure can easily be performed with a low cost.

(5) The thickness of the structure can be reduced. When a sound absorbing panel structure is employed, an integrated panel structure can be realized. Easiness in handling is required, and the portion for which the structure is provided is not limited.

(6) Recycling can easily be performed.

(7) Satisfactory weather resistance can be realized.

A first aspect of the present invention has a structure comprising: a surface plate constituted by a plate-like or planar sound absorbing member; a rear air layer; and a slit resonant sound-absorbing structure which are formed in the rear of the sound absorbing member. The plate-like or planar sound absorbing member serving as the surface plate, the rear air layer and the slit resonant sound absorbing structure are unified into one structure.

A second aspect of the present invention has a structure comprising: a surface plate constituted by a sound absorbing member obtained by compression molding metal fibers into a plate-like shape; a rear air layer; and a slit resonant sound absorbing structure which are formed in the rear of the sound absorbing member. A third aspect of the present invention has a structure that each of five sides of the sound absorbing member except for the surface plate has a hollow box-shape structure constituted by a plate-like member made of a non-ventilation material.

A fourth aspect of the present invention has a structure that a plurality of elongated members for constituting the air layer are disposed below the sound absorbing member at positions apart from one another for a predetermined distances, and the slit resonant sound absorbing structure is constituted by using the gaps between adjacent elongated members. A fifth aspect of the present invention has a structure that the sound absorbing member is supported by a plurality of elongated members disposed in the structure at positions apart from one another for a predetermined distance, each of the elongated members has a concave cross sectional shape which has an internal space in which a rear air layer of the sound absorbing member is formed and which is made of a non-ventilation material, and a slit resonant sound absorbing structure is formed in a gap between the elongated members and the bottom surface of the structure and a gap between adjacent elongated members. The bottom surface of the structure means a bottom plate when the structure is the sound absorbing panel. When the structure is integrally joined to the wall surface of a building structure, the bottom surface means the surface of the wall.

A sixth aspect of the present invention has a structure that one or more types of rear air layer and slit resonant sound absorbing structures are formed in each of the internal spaces (a recessed internal space) of the elongated members. When one or more types of individual elongated members are disposed in the internal space of the elongated members, the rear air layer and the slit resonant sound absorbing structure having a new shape and dimensions are formed.

A seventh aspect of the present invention has a structure that a plurality of the widths of the rear air layer or/and the widths (the slit widths) of a slit opening of the slit resonant sound absorbing structure are set. The widths of the grooves and the slits are not made to be constant. The widths of the grooves and the slits are varied widely. The slit widths may be changed in accordance with a predetermined rule, or the change may be realized without any rule. In addition, the widths of the grooves and slits formed in the internal spaces of the elongated members are changed.

An eighth aspect of the present invention has a structure that a sound absorbing characteristic of the rear air layer and the sound absorbing characteristic of the slit resonant sound absorbing structure are compensated each other so as to obtain the sound absorbing performance in a wide frequency range. When the sound absorbing performance of each of the rear air layer and the slit resonant sound absorbing structure are graphed, trough portions in each of which the sound absorption coefficient is low are compensated each other. Thus, the trough portions are eliminated to eradicate the frequency range which cannot be absorbed.

The ninth aspect of the invention has a structure that the concave cross sectional shape of the elongated member is formed into anyone of a U-shape facing side, a U-shape, a V-shape, a semi-circular shape, a triangular shape, a trapezoidal shape or their mixture. The tenth aspect of the invention has a structure that the structure is reinforced by the elongated members. The eleventh aspect of the invention has the structure that the resonant sound absorbing structure is constituted by using the wall surfaces of a building structure.

According to the first and second aspects of the present invention, the plate-like or planar sound absorbing member, and in particular a sound absorbing member obtained by compression molding metal fibers is employed as the surface plate of the structure. Moreover, the rear air layer of the sound absorbing member and the slit resonant sound absorbing structure are formed in the structure. Thus, high sound absorbing performance and, in particular, satisfactory sound absorbing performance to a low frequency can be obtained. Moreover, an integrated-type sound absorbing panel exhibiting satisfactory handling easiness can be obtained.

When a sound wave in a specific resonant frequency range (which is somewhat broad range) has been made incident on the slit resonant sound absorbing structure, a resonance phenomenon occurs. Thus, air blocks are fiercely introduced/discharged with respect to the slit portions. At this time, the acoustic resistance of the slit portion causes the kinetic energy of the movement of air to be lost. Thus, the acoustic energy is lost.

Thus, sound absorption in the specific frequency range can be realized. In the present invention, the sound absorbing members constituted by the metal fibers are disposed in the openings of the slits. Therefore, the resistance which is exerted on the air which is introduced/discharged with respect to the slits when resonance occurs is raised. Therefore, the sound absorption owing to the foregoing mechanism is performed at a high efficiency. Since thin plate-like sound absorbing members are employed, spaces required for the rear air layer and the slit resonant sound absorbing structure can effectively be created in a limited space.

The third aspect of the invention incorporates the hollow box-shape structure having the bottom plate and the right and left side plates except for the surface plate of the sound absorbing member are made of non-ventilation material materials. Therefore, a sound absorbing panel having a simple structure, high strength and easy handling characteristic can be obtained. Moreover, the air inlet/outlet openings of the slit resonant sound absorbing structure are limited to only the slit portions. Therefore, the sound absorbing effect can be improved.

The fourth, fifth and ninth aspects of the invention enabled the rear air layer of the sound absorbing member and the slit resonant sound absorbing structure to be obtained with a simple structure. Moreover, a structure with which the sound absorbing member can be reliably supported can be obtained. In addition, the elongated members enable the depths (for example, the dimension in the direction of the depth of a gap 11 shown in FIG. 2) of the necks of the slit resonant sound absorbing structure to be maintained. Thus, a limited resonant space can be used to obtain a resonant sound absorbing structure which is effective to a bass range.

The sixth aspect of the invention enables the rear air layers and the slit resonant sound absorbing structures having different shape and dimensions to be obtained in the sound absorbing structure. The seventh aspect of the invention enables two or more types of the rear air layers and slit resonant sound absorbing structures having different groove widths and slit widths to be obtained.

The tenth aspect of the invention enables a sound absorbing panel having a robust structure and exhibiting excellent handling characteristic to be obtained. That is, the slit resonant sound absorbing structure can be formed by the elongated members, and the sound absorbing members can reliably be supported. Moreover, the elongated members serve as beams so that reinforced sound absorbing panels are obtained. The eleventh aspect of the invention uses the wall surfaces of a building structure as a substitute for the bottom plates of the sound absorbing panels so that a low-cost sound absorbing structure is obtained which effectively uses the space.

DETAILED DESCRIPTION OF THE PREFERRED EMBODIMENTS

Figure 1:
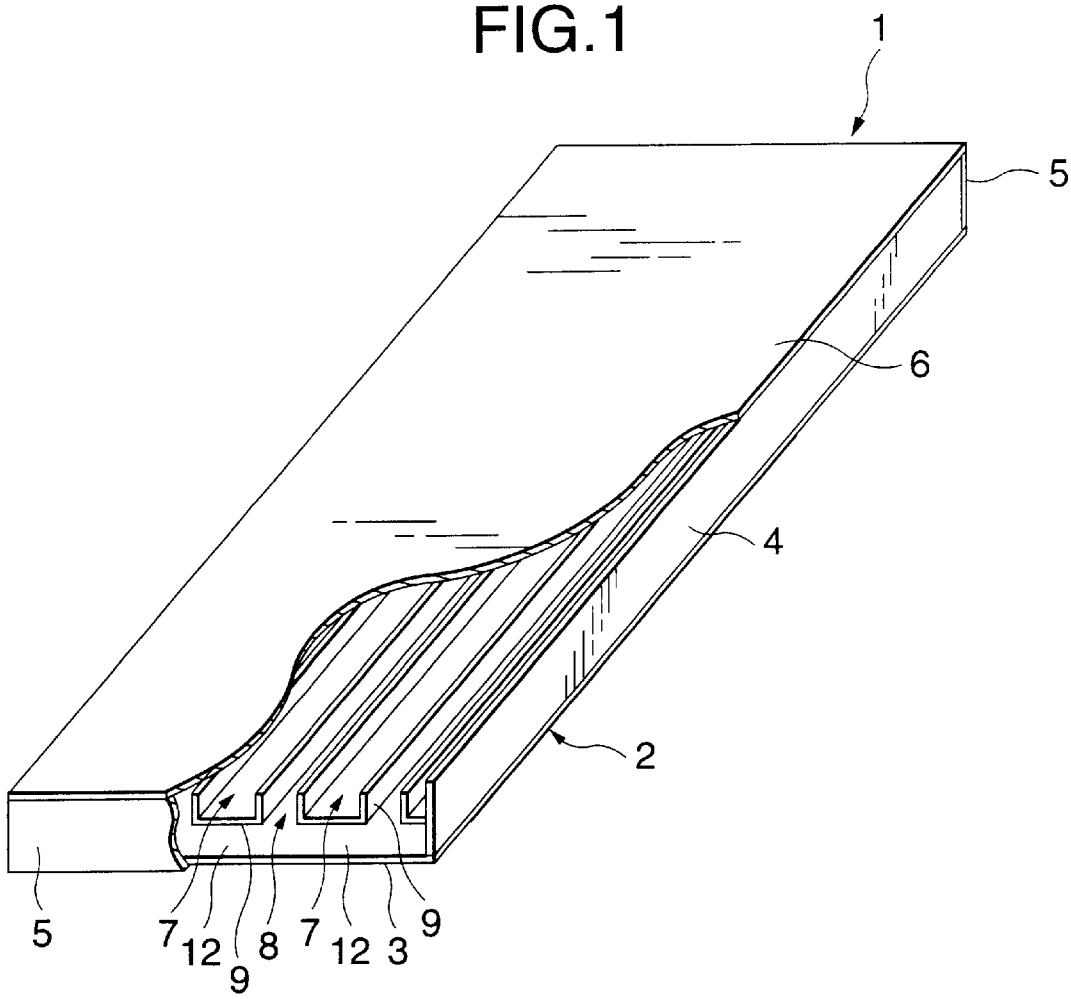
FIG. 1 is a partially-cut perspective view showing a sound absorbing panel according to the present invention.
Figure 2:
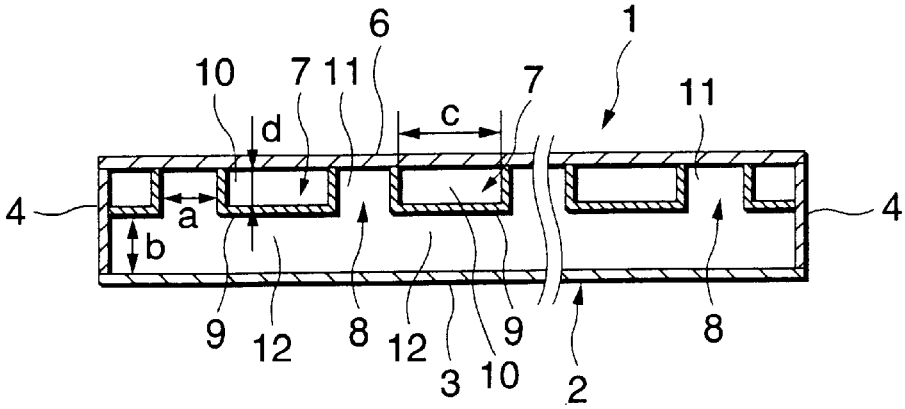
FIG. 2 is an enlarged cross sectional view showing the internal structure of the sound absorbing panel.
Figure 3:
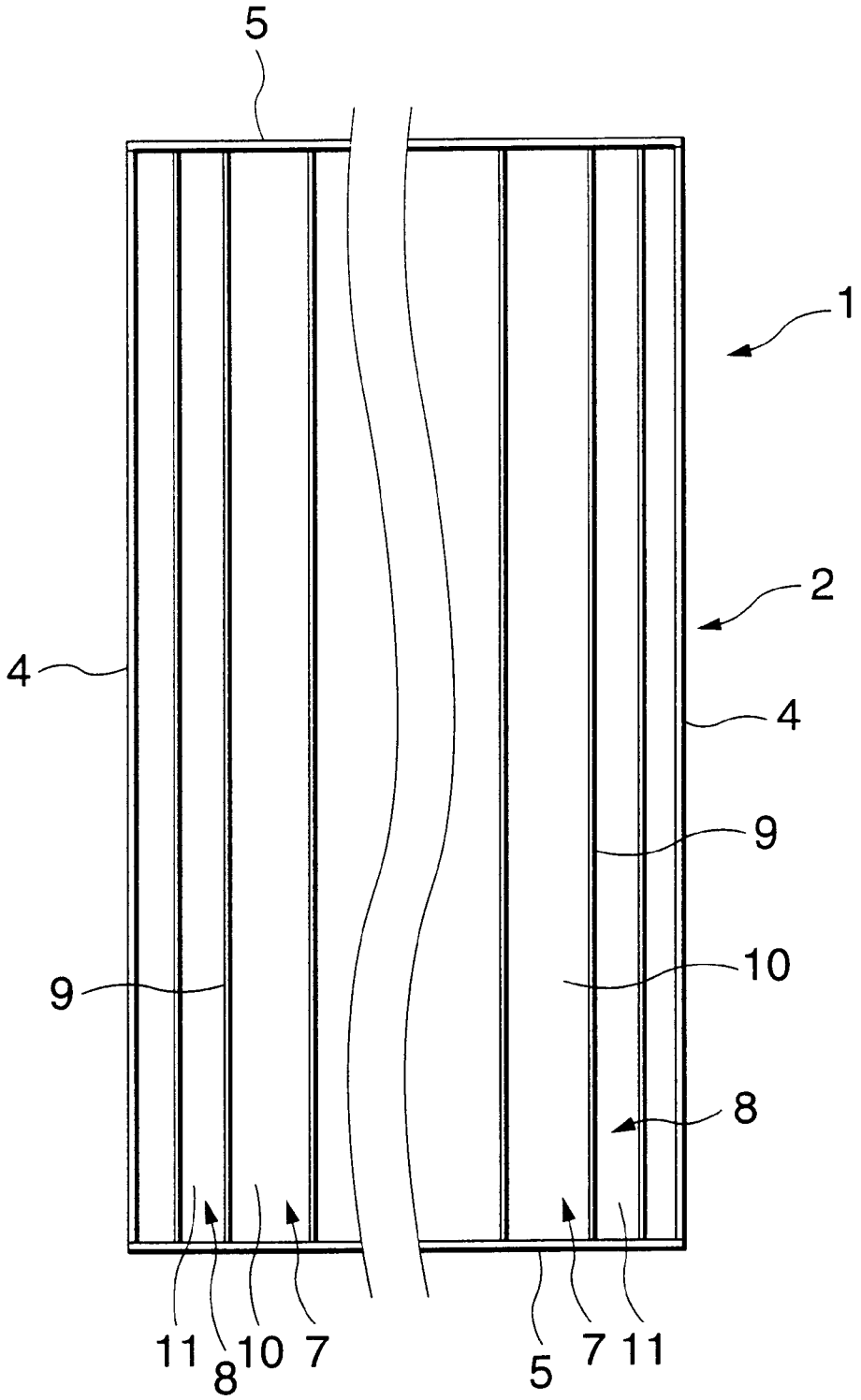
FIG. 3 is a plan view showing the sound absorbing panel from which a sound absorbing member of a surface plate has been omitted.
Figure 4:
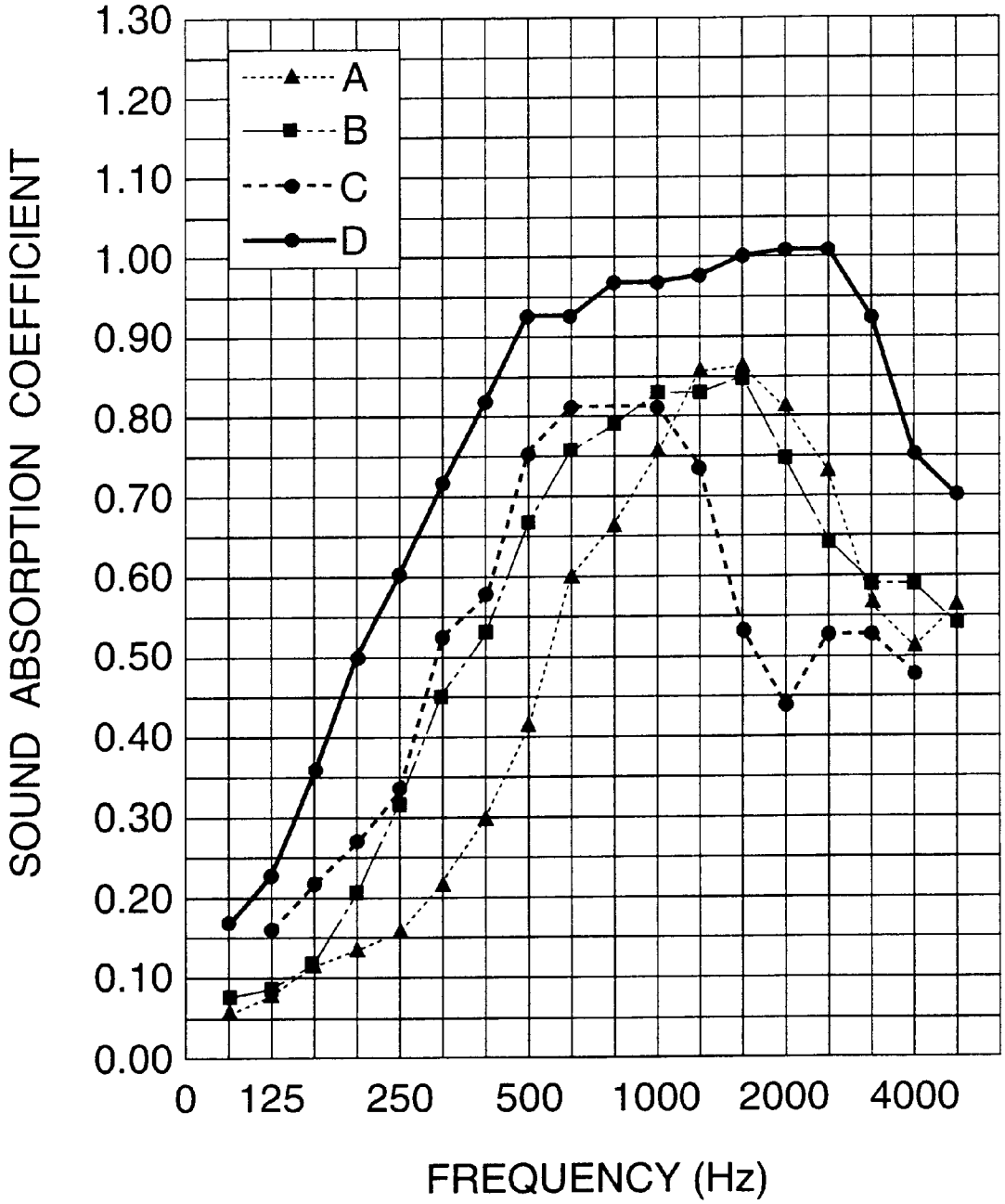
FIG. 4 is a graph showing the sound absorbing characteristic of the sound absorbing panel.

An embodiment of the present invention will now be described with reference to the drawings. FIG. 1 is a partially-cut perspective view showing a sound absorbing panel according to the present invention. FIG. 2 is an enlarged cross sectional view showing the internal structure of the sound absorbing panel. FIG. 3 is a plan view showing the sound absorbing panel from which the sound absorbing member of the surface plate has been omitted. FIG. 4 is a graph showing sound absorbing performance of the sound absorbing panel.

As shown in FIGS. 1 to 3, a sound absorbing panel 1 according to the present invention incorporates a hollow box-shape structure 2. A bottom plate 3 and right and left side plates 4 and two end plates 5 are made of non-ventilation materials. A surface plate on the residual side is constituted by a sound absorbing member 6 obtained by compression molding metal fibers into a sheet shape. The hollow box-shape structure 2 includes a rear air layer 7 of the sound absorbing member 6 and a resonant sound absorbing structure 8 constituted by slits. Note that the sound absorbing member 6 may be made of a material except for the metal fibers. For example, a high-density unwoven fabric or a porous material may be employed. From viewpoints of cost and weight-reduction, improvement in the performance and easiness of recycling, it is preferable-that aluminum fibers are employed.

As described above, the hollow box-shape structure 2 has the structure that the bottom plate 3 and the right and left side plates 4 except for the surface plate of the sound absorbing member 6 are made of the metal material or the like which is a non-ventilation material. The non-ventilation material may be made of metal or non-metal material in the form of a steel plate, an aluminum plate, any one of a variety of alloy plates, a resin plate, a wood plate or their laminated plate. Although the sound absorbing performance somewhat deteriorates, the right and left side plates 4 may be made of a ventilation material. As an alternative to the right and left side plates 4, a structure reinforced by square bars may be employed.

It is preferable that the sound absorbing member 6 is a plate-like member made of metal fibers, such as aluminum fibers and having a thickness of about 1 mm to about 5 mm. When the aluminum fibers are employed, it is preferable that a plate-like member is employed which is obtained by compression molding fibers each having a diameter in a range between 50 $\mu$m and 200 $\mu$m such that the surface density is 500 g/m$^2$ to 4000 g/m$^2$. As an alternative to the aluminum fibers, a structure may be employed which is obtained by similarly compression molding stainless steel fibers.

The right side and/or the reverse side of the sound absorbing member 6 made of the metal fibers may be provided with a coating material, such as punching metal or expand metal, which does not deteriorate the sound absorbing performance.

The rear air layer 7 provided for the inside portion of the hollow box-shape structure 2 is constituted by an internal space 10 of a plurality of elongated members 9 disposed in the lengthwise direction at positions below the sound absorbing member 6 at arbitrary distances and each having a concave cross sectional shape. Gaps 11 between adjacent elongated members 9 define respective slits. A resonant sound absorbing structure 8 is formed by the slit and a resonant space 12.

As described above, the resonant sound absorbing structure 8 uses the Helmholtz resonant structure as the basic principle thereof. Therefore, the resonant sound absorbing structure 8 has a sound absorbing effect at a sound absorbing frequency which is determined according to the dimensions and size of the gap 11, the capacity of the resonant space 12, acoustic resistance of the sound absorbing member 6 or the like. In particular, the foregoing structure enables the dimension of the direction of the depth of the slit, that is, the dimension (the length of the neck) in the direction of the depth of the gap 11, to be elongated. Therefore, the resonant frequency can be set to a further bass range in spite of the small thickness of the sound absorbing panel. In a case of the foregoing resonant sound absorbing structure 8, a multiplicity of parameters excessively complicatedly concern one another to easily and accurately determine the resonant frequency. When a sound absorbing panel exhibiting excellent sound absorbing effect is manufactured, optimum dimensions must be experimentally determined.

The shape of each of the elongated members 9 must have the concave cross sectional shape as shown in the drawings. Specifically, the concave cross sectional shape may be any one of a U-shape facing side, a U-shape, a V-shape, a semi-circular shape, a triangular shape, a trapezoidal shape and their mixture may be employed. In general, the U-shape facing side is employed to obtain high sound absorbing performance in spite of a simple structure.

The elongated member 9 is made of a metal material or the like which is a non-ventilation material. Specifically, a steel plate, an aluminum plate, any one of a variety of alloy plates, a resin plate, a wood plate or their laminated plate may be employed. Note that use of a ventilation material to form the elongated member is undesirable because the function of the resonant sound absorbing structure 8 and that of the rear air layer 7 deteriorate.

The elongated members 9 support and reinforce the sound absorbing member 6. The two ends of the elongated member 9 are secured to the two end plates 5 of the hollow box-shape structure 2 so that the elongated members 9 serve as beams for reinforcing the hollow box-shape structure 2.

When the present invention is embodied, the shape of the sound absorbing panel 1 may be formed into, for example, a curved structure except for the box-shape structure which is the rectangular parallelepiped. Also the planar shape of the sound absorbing panel 1 is not limited to the rectangular shape.

An embodiment of the sound absorbing panel shown in FIGS. 1 to 3 will now be described. The dimensions described in this embodiment are preferred examples detected by the inventors of the present invention. The embodiment of the present invention is not limited to the employed dimensions. Although the structure for joining the sound absorbing panel is omitted from description, the joining structure is, of course, added or modified. Note that the same elements in the drawings are given the same reference numerals.

The outer surface of the hollow box-shape structure 2 constituting the sound absorbing panel 1 is composed of a bottom plate 3 constituted by an aluminum plate having a thickness of 2 mm, the right and left side plates 4, the two end plates 5 and the surface plate constituted by the sound absorbing member 6.

The hollow box-shape structure 2 includes the plural elongated members 9 each of which is constituted by an aluminum plate having a thickness of 1.5 mm and having the cross sectional shape formed into a U-shape. The two ends of the elongated member 9 is secured to the two end plates 5.

The sound absorbing member 6 is obtained by binding aluminum fibers each having a diameter of 100 $\mu$m with an organic binder. The density is 1.3 g/cm$^3$ and the thickness is 1.5 mm. In the foregoing case, the surface density is 2000 g/m$^3$.

The sound absorbing member 6 is obtained by initially applying pressure to molten aluminum to cause molten aluminum to be jetted out through a nozzle having a small caliber. Then, the molten aluminum is cooled so that aluminum fibers are obtained. As described above, the organic binder is added to the aluminum fibers so as to be compression molded into a plate-like shape.

The sound absorbing panel 1 shown in FIGS. 1 to 3 has a structure that the peak of sound absorption obtainable from the sound absorbing member 6 and the rear air layer 7 and the peak (the resonant frequency) of the slit resonant sound absorbing structure 8 are intentionally shifted from each other.

When the foregoing structure is employed, excellent sound absorbing performance can be obtained in a wide frequency range. Drain holes (not shown) are formed in the bottom plate 3 and the side plates 4 of the sound absorbing panel 1 for outdoor use. The drain holes must have small sizes so that resonance is not obstructed.

Although the sound absorbing panel has a large size of 500 mm×2000 mm, the weight can be reduced to be lighter than 20 kg and the thickness can be reduced to about 95 mm. However, excellent sound absorbing performance can be realized in the bass range.

The sound absorbing performance of the sound absorbing panel 1 is shown in FIG. 4. The sound absorbing performance is indicated with a result of measurement of dependency of the sound absorption coefficient on the frequency. Symbol D indicates the sound absorbing performance of the sound absorbing panel 1. Symbols A to C show sound absorbing performance of structures in which rear air layers each having a thickness of 60 mm, 80 mm and 100 mm are provided on the rear of the sound absorbing member 6 constituted by the aluminum fibers.

The performance indicated with A to C correspond to the performance of the sound absorbing panel 1 which is shown in FIG. 3, which is not provided with the elongated members 9 and which incorporates the sound absorbing member 6 as the surface plate. That is, the performance indicated with A to C is the sound absorbing performance of the sound absorbing effect realized by only the sound absorbing member 6 and the rear air layer such that the slit resonant sound absorbing structure 8 is not provided.

As can be understood from FIG. 4, the sound absorbing panel 1 according to this embodiment has excellent sound absorbing performance in a wide frequency range. The reason for this lies in the combination of the sound absorbing structure in which the air layer is provided in the rear of the sound absorbing member (that is, a first sound absorbing structure) and a sound absorbing structure (that is, a second sound absorbing structure) realized by the resonance occurring in the slits.

The reason why the sound absorption coefficient is raised as well as the effect that the sound absorbing frequency range is widened lies in that the peak of the sound absorbing performance of the first sound absorbing structure and that of the sound absorbing performance of the second sound absorbing structure are shifted. Moreover, their sound absorbing performance levels are added.

The sound absorbing performance indicated with symbol A shown in FIG. 4 is such that the sound absorbing performance in the bass range is low because the rear air layer has a small thickness of 60 mm. The sound absorbing performance indicated with symbol B is such that the sound absorbing performance in the bass range is improved as compared with the performance indicated with A because the rear air layer has a large thickness of 80 mm which is larger than the structure having the performance indicated with A.

The sound absorbing performance indicated with symbol C is realized by making the thickness of the rear air layer to be 100 mm. The performance in the bass range cannot be satisfactorily improved as compared with the performance indicated with B. What is worse, the sound absorbing performance in the high tone range deteriorates. The reason for this will now be described. When the sound absorbing member made of metal fibers has the rear-air layer, the sound absorbing performance has a peak with respect to a specific frequency. When the thickness of the rear air layer is enlarged, the foregoing trend becomes conspicuous. The reason why the maximum value of the sound absorption coefficient shown in FIG. 4 is larger than one lies in the measuring method using reverberation. The substantial maximum value of the sound absorption coefficient is one.

In this embodiment, the sound absorbing performance of the sound absorbing panel 1 can be controlled by changing the thickness of the plate-like sound absorbing member 6, the thickness of the rear air layer 7, the volume of the resonant space 12 and the dimensions of the slit openings.

When the thickness of the sound absorbing panel 1 is enlarged and the volume of the resonant space 12 of the slit resonant sound absorbing structure 8 is enlarged, the sound absorption coefficient can be raised in a further bass range. It is preferable that the sound absorbing panel for use to meet a usual sound absorbing purpose has the dimensions such that a=25 mm, b=55 mm, c=30 mm and d=35 mm shown in FIG. 2 satisfy a range of ±10 mm.

In accordance with results of computer simulations performed by the inventors of the present invention, an average oblique incident sound absorption coefficient of 0.9 or higher can be obtained with respect to road traffic noise when the dimensions are appropriately set as described above.

In this embodiment, the peak of the sound absorption realized by the sound absorbing member 6 and the rear air layer 7 and the peak of the sound absorption realized by the resonant sound absorbing structure 8 are intentionally shifted from each other. The two peaks of the sound absorption may intentionally made coincide with each other. The foregoing structure is effective when only a specific frequency is selectively absorbed.

In this embodiment, the inside portion of the sound absorbing panel 1 is provided with only the elongated member 9, that is, no member is filled. Any one of known sound absorbing members may be disposed or filled in the inside portion. Another type sound absorbing material may be laid over the sound absorbing member 6.

FIGS. 5 and 7 to 10 are enlarged cross sectional views showing the internal structure of a sound absorbing panel having a structure that one or more types of the rear air layers and the slit resonant sound absorbing structure are formed in the internal space 10 of the elongated member 9.

Figure 5:
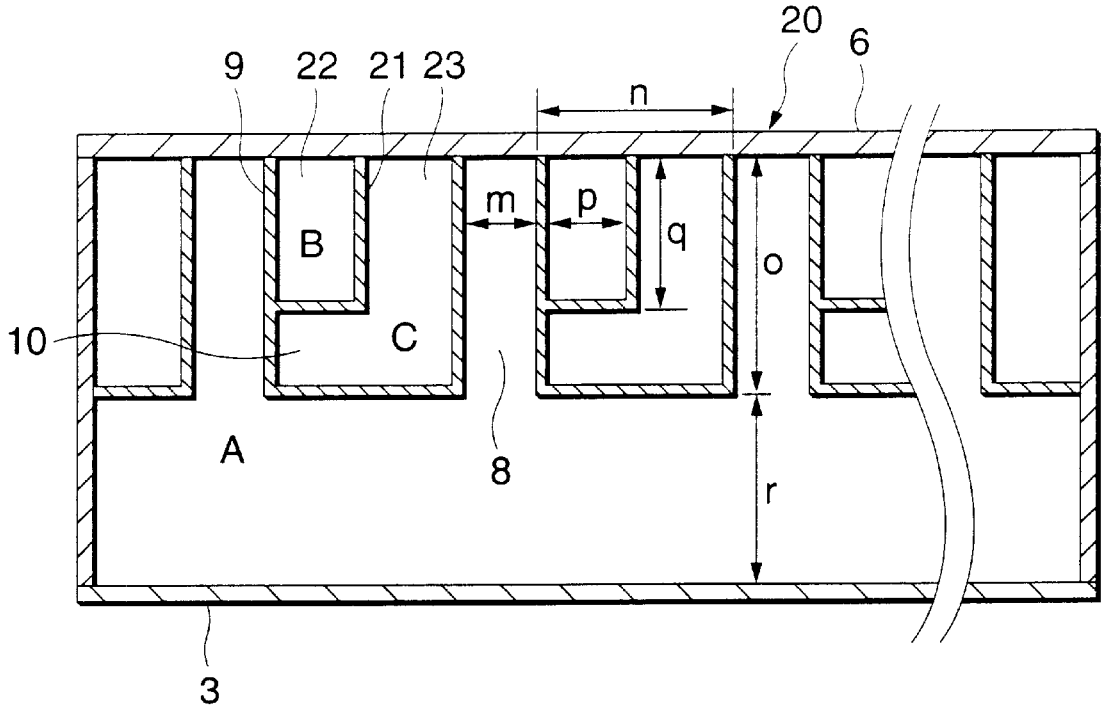
FIG. 5 is an enlarged cross sectional view showing the internal structure of another sound absorbing panel.

A sound absorbing panel 20 shown in FIG. 5 has an internal space 10 which is partitioned by L-shape elongated members 21 so that a rear air layer 22 and a slit resonant sound absorbing structure 23 are formed. The sound absorbing panel 20 enables slit resonant sound absorbing structures 8 and 23 having different shapes and sizes to be formed in one sound absorbing panel. In the foregoing case, the same slit resonant sound absorbing structure having the different shapes and dimensions enables different sound absorbing performance to be exhibited. Thus, superimposed sound absorbing performance can be obtained.

Figure 6A:
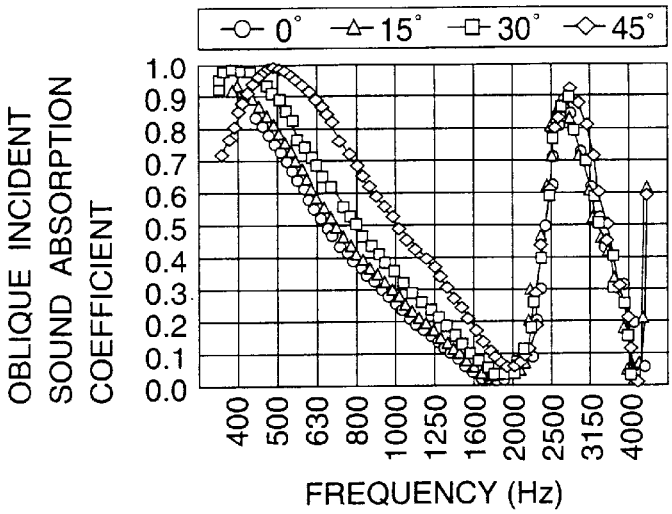
FIGS. 6A to 6C are graphs showing the sound absorbing characteristics of the sound absorbing panel in FIG. 5.
Figure 6B:
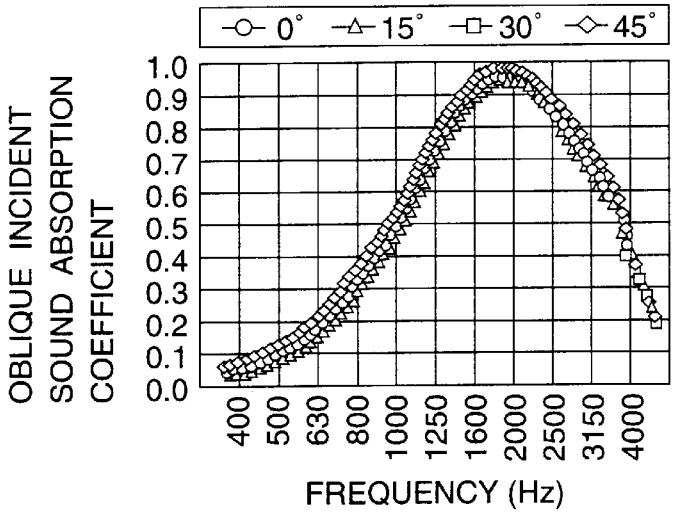
Figure 6C:
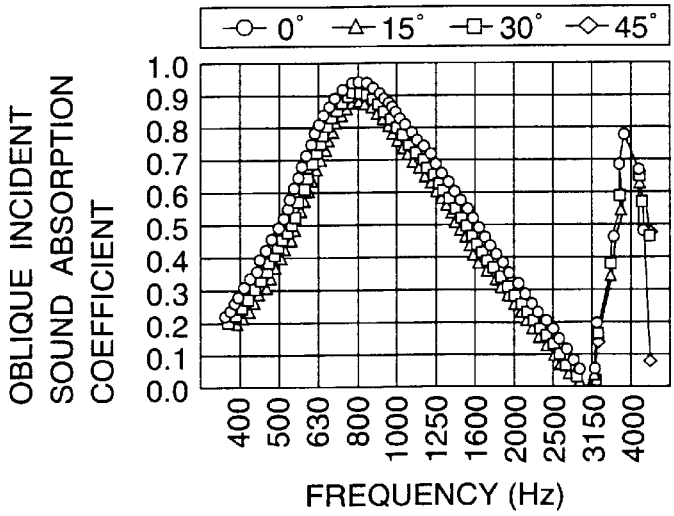

FIGS. 6A to 6C are graphs showing the sound absorbing performance of the sound absorbing panel 20 shown in FIG. 5. The graphs show three regions A, B, and C. In FIG. 6A, region A shows the sound absorbing performance of only the slit resonant sound absorbing structure 8. In FIG. 6B, region B shows the sound absorbing performance of only the rear air layer 22. In FIG. 6C, region C shows the sound absorbing performance of only the slit resonant sound absorbing structure 23. As can be understood from the graphs, the slit resonant sound absorbing structures 8 and. 23 which are the same slit resonant sound absorbing structure have different shapes and dimensions. Therefore, the different sound absorbing performance is realized. Hence it follows that the frequency range which cannot be absorbed by the slit resonant sound absorbing structure 8 can be absorbed by the slit resonant sound absorbing structure 23. Thus, the resonant frequency range can be widened as compared with the sound absorbing panel shown in FIG. 2 and incorporating only one type of the rear air layer and the slit resonant sound absorbing structure.

Figure 7:
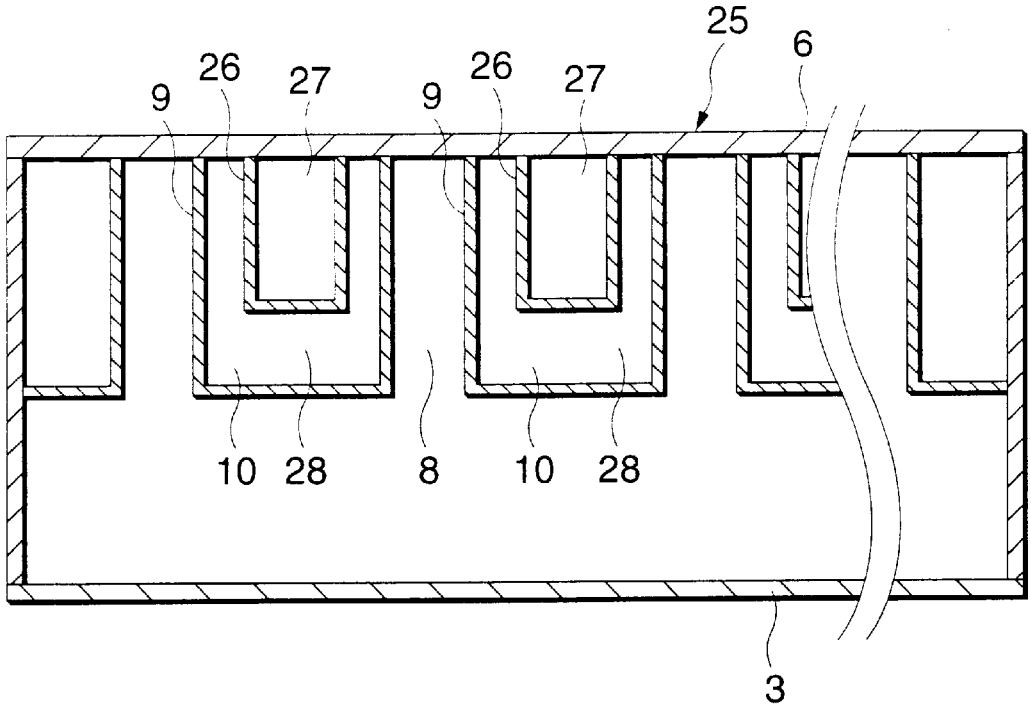
FIG. 7 is an enlarged cross sectional view showing the internal structure of another sound absorbing panel.

A sound absorbing panel 25 shown in FIG. 7 has the internal space 10 of the elongated members 9 which is sectioned by elongated members 26 with a U-shaped cross section. Similarly to the sound absorbing panel 20, one type of the rear air layer 27 and two types of the slit resonant sound absorbing structures 8 and 28 are provided.

Figure 8:
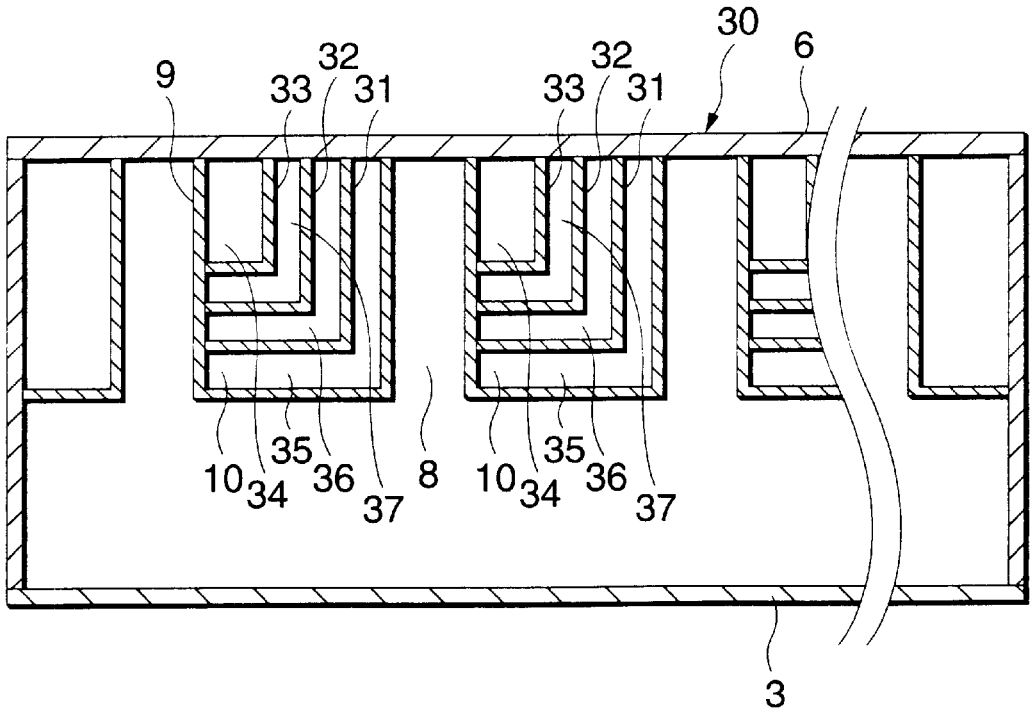
FIG. 8 is an enlarged cross sectional view showing the internal structure of another sound absorbing panel.
Figure 9:
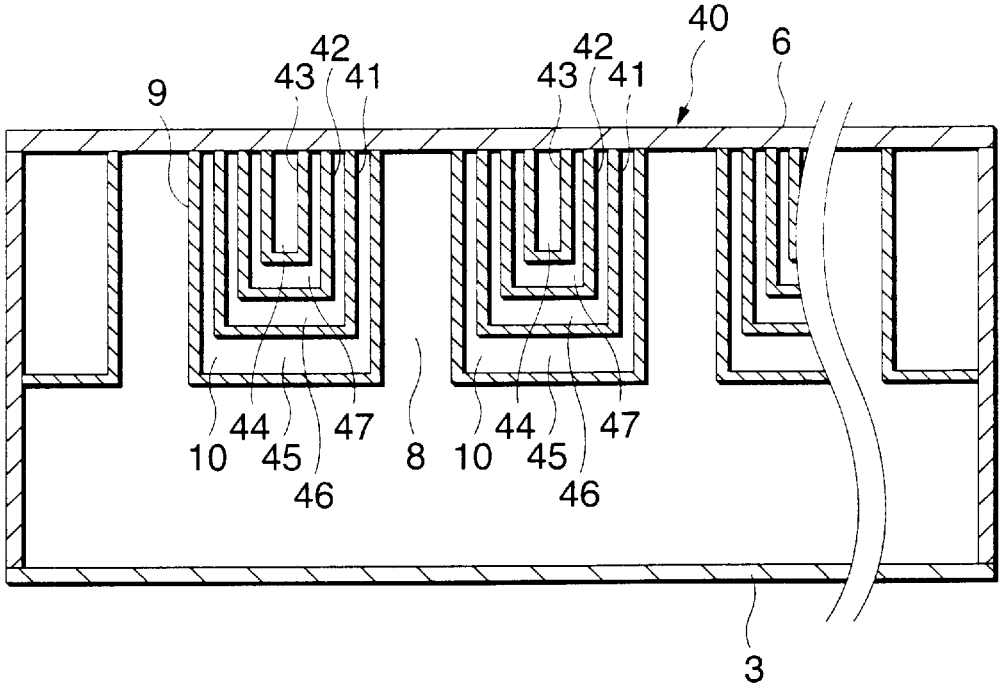
FIG. 9 is an enlarged cross sectional view showing the internal structure of another sound absorbing panel.
Figure 10:
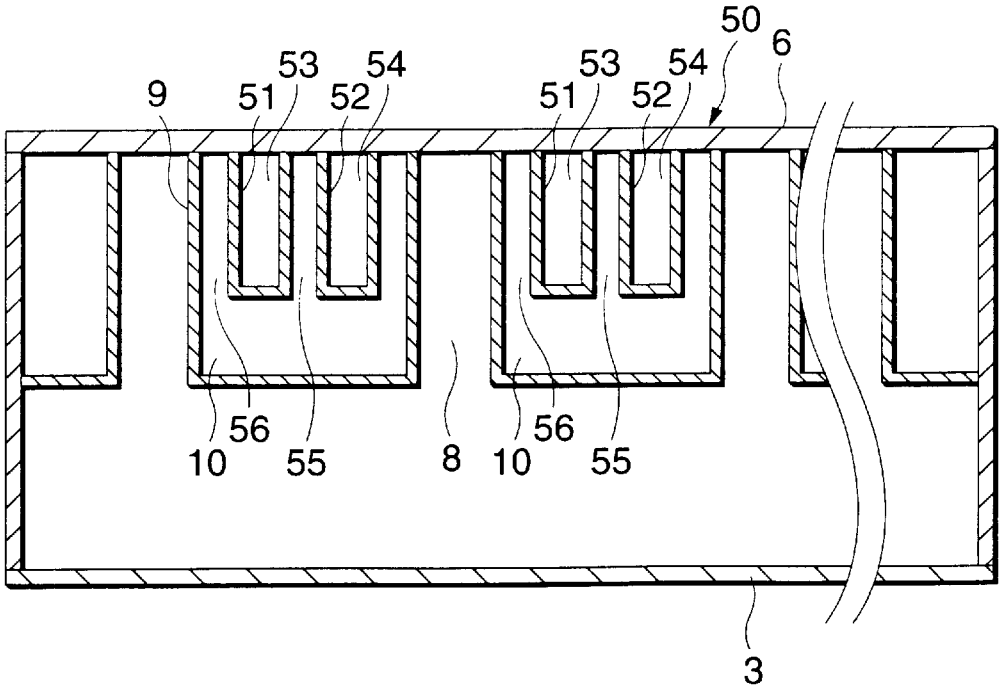
FIG. 10 is an enlarged cross sectional view showing the internal structure of another sound absorbing panel.

Sound absorbing panels 30, 40 or 50 shown in FIG. 8 to 10 may be employed. That is, a plurality of elongated members are disposed in the internal space 10 so as to form plural types of rear air layers or slit resonant sound absorbing structures. Also in the foregoing case, the rear air layers and the slit resonant sound absorbing structures having different shapes and dimensions exhibit different sound absorbing performance.

A sound absorbing panel 30 shown in FIG. 8 has the internal space 10 which is sectioned into a plurality of sections by L-shape elongated members 31, 32, 33, . . . , having different sizes. Thus, a rear air layer 34 and plural types of slit resonant sound absorbing structures 8, 35, 36, 37, . . . , are formed. A sound absorbing panel 40 shown in FIG. 9 has the internal space 10 which is sectioned into a plurality of sections by elongated members 41, 42, 43, . . . , having different sizes and each having a U-shaped cross section. Thus, a rear air layer 44 and plural types of slit resonant sound absorbing structures 8, 45, 46, 47, . . . , are formed. A sound absorbing panel 50 shown in FIG. 10 has the structure that elongated members 51, 52, . . . , each having a U-shaped cross section are arranged on the lower surface of the sound absorbing member 6 in the internal space 10. Thus, rear air layers 53, 54, . . . , and slit resonant sound absorbing structures 8, 55 and 56 are formed.

The rear air layers and the slit resonant sound absorbing structure in the internal space 10 formed in one sound absorbing panel are not required to have the same structure. A plurality of different types may be combined with one another. For example, a combination (not shown) of sound absorbing panels 20 and 30 may be combined with each other. The structure of the sound absorbing panel is not limited to the illustrated structure.

Figure 11:
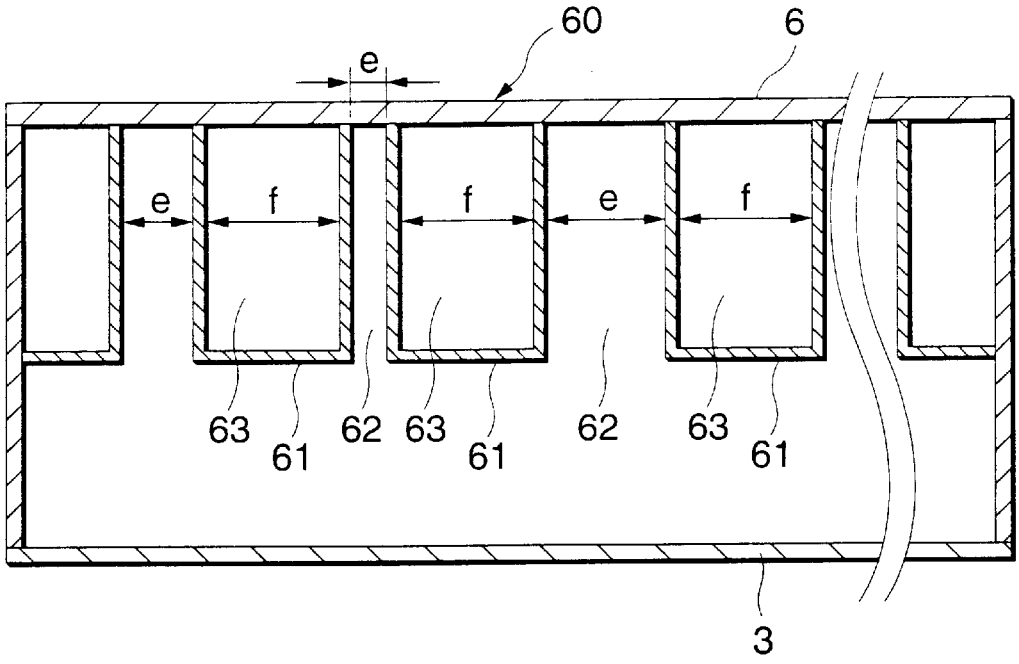
FIG. 11 is an enlarged cross sectional view showing the internal structure of another sound absorbing panel.
Figure 12:
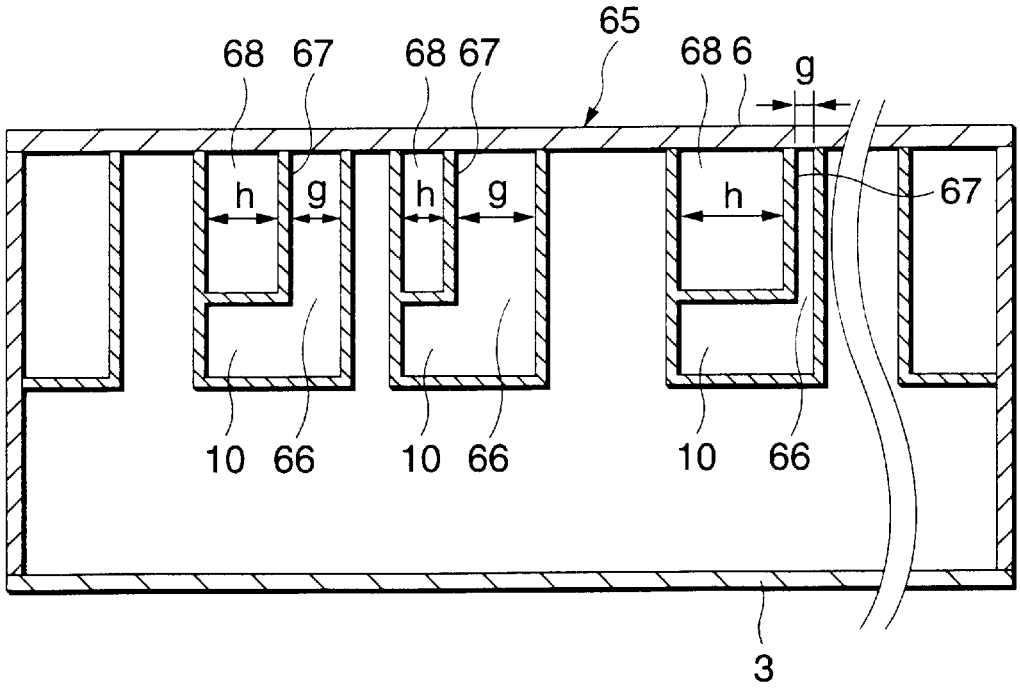
FIG. 12 is an enlarged cross sectional view showing the internal structure of another sound absorbing panel.

A sound absorbing panel 60 shown in FIG. 11 incorporates slit resonant sound absorbing structure 62 formed in gaps positioned between the elongated members 61 and the bottom plate 3. Slits form portions of the gaps that are positioned between adjacent elongated members 61. The slits have a slit width e, which can be varied between panels. Since the slit width e can be varied, a variety of resonant sound absorbing structures can be realized. The variation of the slit width e is not limited to the variation shown in the drawing. The slit width e may gradually be enlarged or the slit width e may be determined to comply with a certain rule. Similarly, the groove width f of the rear air layer 63 may be varied. A sound absorbing panel 65 shown in FIG. 12 may be employed in which the slit width g of the slit resonant sound absorbing structure 66 formed in the internal space 10 or the groove width h of the rear air layer 68 is varied.

As an alternative to the sound absorbing panel having the independent structure, the sound absorbing structure may be constituted by using the wall surface of a building structure. That is, the wall surface of a building structure is substituted for the portion corresponding to the bottom plate 3 shown in FIGS. 2 and 5. Thus, a structure in which the sound absorbing structure according to the present invention is integrally joined to the wall surface of the building structure can be obtained. In the foregoing case, a limited space can effectively be used. Moreover, a light-weight sound absorbing structure which can easily be installed can be obtained. The wall surface of a building structure is the surface of a structure on which the sound absorbing structure is attempted to be joined. Specifically, the building structure is exemplified by the wall or the ceiling of a building, the wall surface of a road formed by digging, the wall surface or the ceiling of a tunnel, the lower surface of an elevated bridge and a wall provided along a road or a railway.

Figures 13, 14:
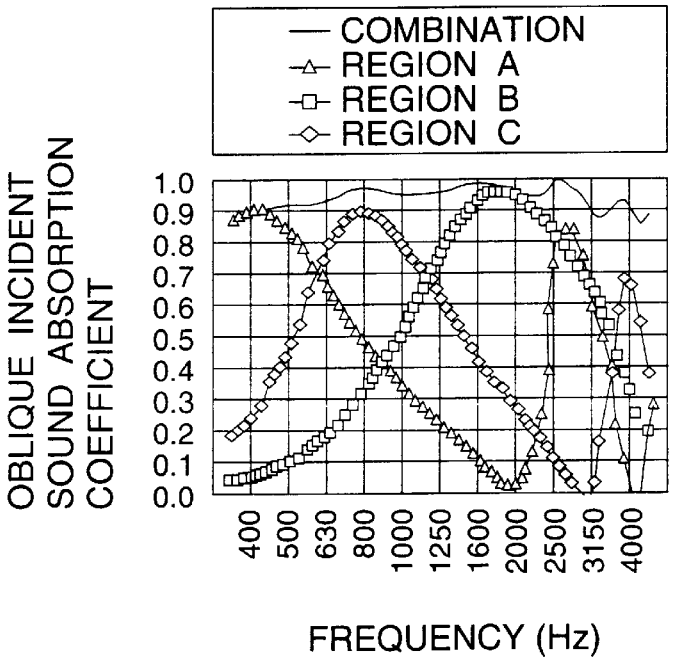
FIG. 13 is an embodiment of an optimum structure of the Sound absorbing panel shown in FIG. 5.
FIG. 14 is a graph showing the sound absorbing characteristic of the sound absorbing panel.

FIG. 13 is an embodiment of an optimum structure of the sound absorbing panel 20 shown in FIG. 5 detected owing to experiments performed by the inventors of the present invention. The sound absorbing performance of the sound absorbing panel 20 is graphed as shown in FIG. 14. The sound absorbing performance of the rear air layer 22 (Region B) and the sound absorbing performance of the slit resonant sound absorbing structures 8 (Region A) and 23 (Region C) mutually compensate. Thus, sound absorption free from any leakage can be realized. That is, the maximum value and the minimum value of the sound absorption curve of the resonant sound absorbing structure 8 and those of the rear air layer 22 mutually compensate. Moreover, the sound absorbing performance of the resonant sound absorbing structure 23 is arranged to have a peak at the intersection between curve A and curve B. In addition, the minimum value of the sound absorbing performance of the slit resonant sound absorbing structure 23 is set at the highest sound absorbing performance. Thus, unsatisfactory portions of the sound absorbing performance can be compensated. Hence it follows that satisfactory sound absorbing performance in a wide frequency range can be obtained. Note that the optimum structure of the sound absorbing panel is not limited to the foregoing embodiment.

The present invention enables a sound absorbing panel which has the following advantages to be obtained.

(1) The rear air layer made of the metal fibers and the resonant sound absorbing structure are combined with each other so that high sound absorbing performance is realized.

(2) The structure is free from any useless portion, that is, a simple and light-weight structure can be realized.

(3) The installation operation can easily be performed with a low cost.

(4) When the sound absorbing panel is structured, a panel structure exhibiting high sound absorbing performance and having a small thickness can be realized. Easy handling is permitted and the location is not limited.

(5) Since the structure is constituted by only metal materials, excellent weather resistance and recycling easiness can be realized.

While only certain embodiments of the invention have been specifically described herein, it will be apparent that numerous modifications may be made thereto without departing from the spirit and scope of the invention.

The present invention is based on Japanese Patent Applications No. Hei. 11-115488 and No. Hei. 11-305412 which are incorporated herein by reference.

What is claimed is:

1. A sound absorbing structure comprising:

a planar surface;

a substantially planar sound absorbing member disposed spaced from said planar surface;

a plurality of elongated members disposed adjacent said sound absorbing member, said elongated members defining an air layer adjacent said sound absorbing member and being made of a non-ventilation material, wherein continuous gaps between said elongated members define respective slits; and a resonant sound absorbing structure including said slits and continuous resonant spaces between said elongated members and said planar surface, wherein said sound absorbing member covers said air layer and said resonant sound absorbing structure.

2. The sound absorbing structure according to claim 1, wherein said sound absorbing member is a surface plate obtained by compression molding metal fibers into a planar configuration.

3. The sound absorbing structure according to claim 1, wherein said structure has a six-sided hollow box-shape structure and wherein one side of said structure is constituted by said sound absorbing member and each of the other five sides is constituted by a planar member made of a non-ventilation material.

4. The sound absorbing structure according to claim 1, wherein said plurality of elongated members are positioned adjacent said sound absorbing member at positions apart from one another at a predetermined distance.

5. The sound absorbing structure according to claim 1, wherein said sound absorbing member is supported by said plurality of elongated members disposed in said structure at positions apart from one another in a predetermined distance, each of the elongated members having a concave cross sectional shape which has an internal space in which said air layer is formed.

6. The sound absorbing structure according to claim 1, wherein at least one of the air layer and the resonant sound absorbing structure is formed in each of the internal space of said elongated members.

7. The sound absorbing structure according to claim 1, wherein at least one of a width of said air layer and a width of the slit is set.

8. The sound absorbing structure according to claim 1, wherein a sound absorbing characteristic of said air layer and a sound absorbing characteristic of said resonant sound absorbing structure compensate each other to obtain sound absorbing performance in a wide frequency range.

9. The sound absorbing structure according to claim 1, wherein each of said elongated members has a cross section shape in one of a concave shape, a U-shape facing side, a U-shape, a V-shape, a semi-circular shape, a triangular shape, a trapezoidal shape and their mixture.

10. The sound absorbing structure according to claim 1, wherein said structure is reinforced by said plurality of elongated members.

11. The sound absorbing structure according to claim 1, wherein said resonant sound absorbing structure is at least partially constituted by using at least one wall surface of a building structure.

12. The sound absorbing structure according to claim 1, wherein said planar surface is at least one wall surface of a building structure.

* * * * *